US005713319A

United States Patent [19]

Tortul

[11] Patent Number: 5,713,319

[45] Date of Patent: Feb. 3, 1998

[54] PHASE VARIATOR

[75] Inventor: Renzo Tortul, S. Pier d'Isonzo, Italy

[73] Assignee: Carraro S.p.A., Campodarsego, Italy

[21] Appl. No.: 679,486

[22] Filed: Jul. 12, 1996

[51] Int. Cl.[6] ..... F01L 1/34

[52] U.S. Cl. ..... 123/90.17; 123/90.31

[58] Field of Search ..... 92/31, 32; 123/90.15, 123/90.17, 90.31

[56] References Cited

U.S. PATENT DOCUMENTS

| | | | |
|---|---|---|---|
| 5,113,814 | 5/1992 | Suga et al. | 123/90.17 |
| 5,247,914 | 9/1993 | Imai et al. | 123/90.31 X |
| 5,263,442 | 11/1993 | Hara | 123/90.17 |
| 5,386,807 | 2/1995 | Linder | 123/90.17 |
| 5,450,825 | 9/1995 | Geyer et al. | 123/90.17 |
| 5,558,053 | 9/1996 | Tortul | 123/90.17 |

FOREIGN PATENT DOCUMENTS

| | | |
|---|---|---|
| 0491410 | 6/1992 | European Pat. Off. . |
| 0571023 | 5/1993 | European Pat. Off. . |
| 0652354 | 5/1995 | European Pat. Off. . |
| 2657648 | 1/1991 | France . |

*Primary Examiner*—Hoang Nguyen
*Attorney, Agent, or Firm*—Sughrue, Mion, Zinn, Macpeak & Seas, PLLC

[57] ABSTRACT

The single-acting phase variator includes a piston actuator movable towards an actuate position, as a result of the admission of a pressurized fluid to a supply chamber through a distribution and discharge duct opening in the chamber against the force of a spring. A valve is provided in the variator for connecting the distribution and discharge duct alternatively to a feed duct for the pressurized fluid or to a discharge opening for the rapid discharge of the fluid from the chamber.

5 Claims, 2 Drawing Sheets

PHASE VARIATOR

BACKGROUND OF THE INVENTION

The present invention relates to a single-acting phase variator of the type comprising a casing, a hub and a piston jointly defining a supply chamber for a pressurized servo means, resilient means urging the piston towards a non-actuated position, and a distribution and discharge duct for the pressurized servo means, opening in the chamber, the piston being moved towards an actuated position under the effect of the servo means supplied to the chamber and with the opposition of the resilient means.

These variators are used in internal combustion engines for changing the phase relationship between the camshaft and the engine shaft.

These variators may be of the double-acting type, when two supply chambers are provided at the opposite axial ends of the piston and the piston is moved as a result of the admission of pressurized oil to one or other of the chambers.

Single-acting variators, in which a single supply chamber is provided and the piston is moved towards an actuated position, against the action of a spring, by the hydraulic thrust generated thereon by the pressure of the oil admitted to the chamber, and is moved towards the opposite, non-actuated position, by the resilient thrust of the spring when the supply of oil to the chamber stops, are also known.

The present invention lies in particular in the technical field of single-acting phase variators.

In these variators, in order to achieve rapid movement of the piston as a result of the hydraulic thrust of the oil, the spring must offer limited resilient resistance. On the other hand, the limited resilient loading of the spring involves the disadvantage of a low resilient thrust generated on the piston during its return stroke towards the non-actuated position when the oil is discharged from the supply chamber under the effect of the resilient load, with a consequent undesired slowing of the piston.

Moreover, it should be borne in mind that the oil is normally discharged from the chamber through the supply duct or through a branch thereof. As a result, the discharged oil, which has to flow back along these ducts and through the control valve, offers considerable resistance to the return of the piston. This tends to slow the piston, particularly when the oil temperature is low.

Compromise solutions are therefore sought but these penalize the performance of the variator both during the actuation stroke and during the return stroke towards the non-actuated position.

The problem upon which the present invention is based is that of providing a phase variator which is designed structurally and functionally to allow the piston to move rapidly during the return stroke towards the non-actuated position, even with limited resilient loads.

SUMMARY OF THE INVENTION

This problem is solved by the invention by means of a phase variator of the type mentioned at the beginning, characterized in that valve means are provided in the distribution and discharge duct and are arranged to connect the duct alternatively to a feed duct for the servo means or to a discharge opening for the rapid discharge of the servo means from the chamber.

BRIEF DESCRIPTION OF THE DRAWINGS

Further characteristics and advantages of the invention will become clearer from the following detailed description of a preferred embodiment thereof, described, by way of non-limiting example, with reference to the appended drawings, in which.

DETAILED DESCRIPTION OF THE INVENTION

Figure 1:
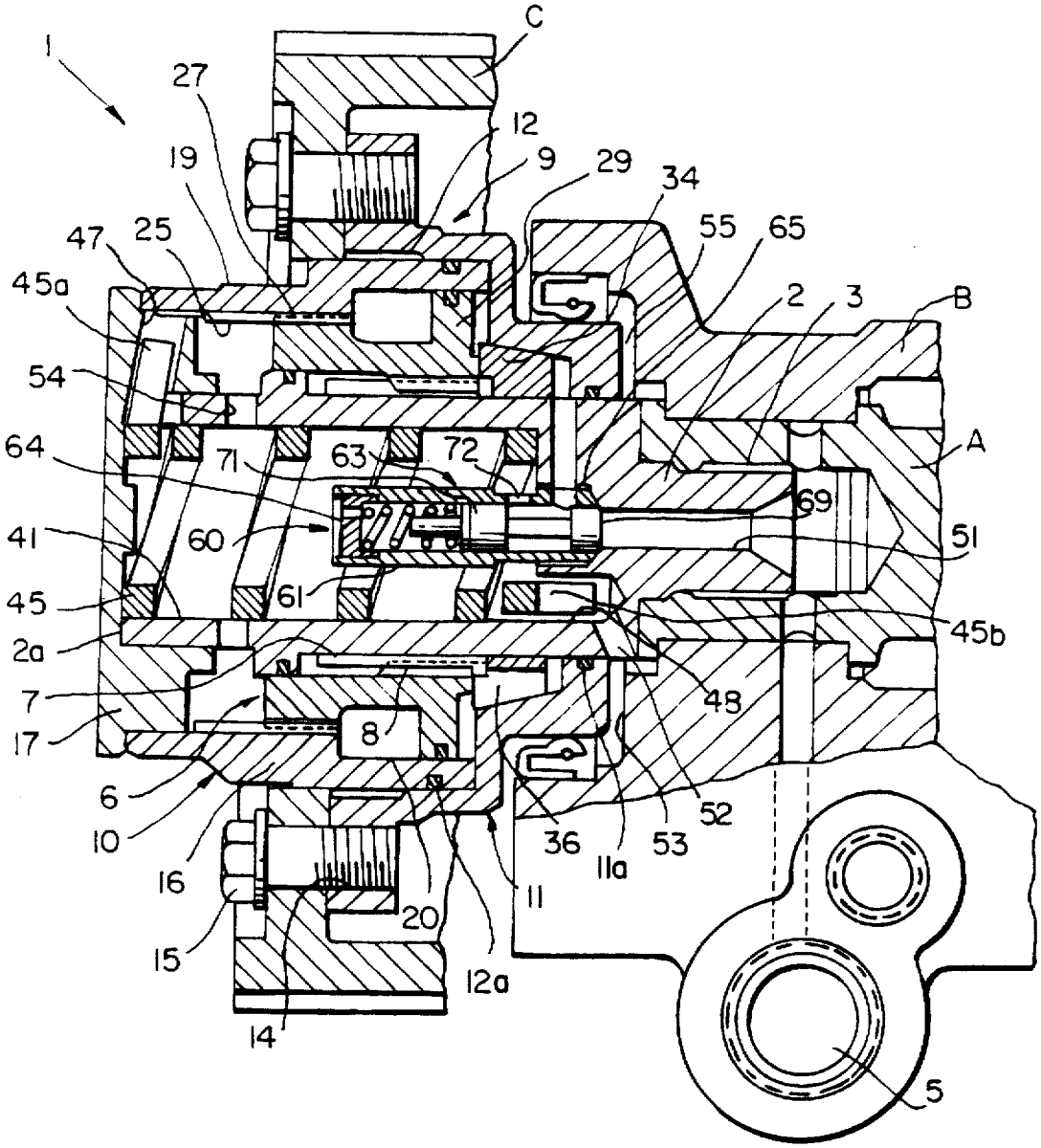
FIGS. 1 and 2 are axial sections of a variator formed according to the present invention, in two different operative positions.

A phase variator according to the invention, generally indicated 1 in the drawings, is intended to be interposed between a camshaft A of an internal combustion engine housed in a structural portion B of the engine, and a transmission, typically of the type with a toothed belt, of which a pulley C is shown, and which controls the timing mechanism of the engine.

The phase variator 1 comprises a hub 2 bearing a threaded shank 3 fixed to the camshaft A by a screw coupling.

An annular piston 6 covers the hub 2, more precisely, a cylindrical portion thereof, so as to be slidable axially on the cylindrical portion of the hub. This portion has axial splines 7 jointly defining a set of straight teeth; in complementary manner, the piston 6 has similar internal splines 8 forming a set of straight teeth complementary to and meshing with the splines 7.

The assembly constituted by the hub 2 and the piston 6 is surrounded by a body constituting a casing 9 of the variator.

The casing 9 is formed by two half bodies 10 and 11 fixed together by a screw coupling 12. Moreover, the half body 10 is sealingly engaged in the half body 11 by means of a seal 12*a*.

The half body 11 has internal threaded holes 14 for the fixing of the pulley C by means of screws 15 and is sealingly engaged on the hub 2 by means of a seal 11*a*.

The half body 10 has a generally cylindrical skirt 16 closed at one axial end by a cover 17 and open at the opposite end. The cover 17 is preferably laser-welded to the skirt 16. The cover 17 has a blind axial hole constituting a seat 18 housing and supporting the free end 2*a* of the hub 2.

Two adjacent cylindrical portions 19, 20 are identified in the skirt 16 of the half body 10.

A set of helical teeth 25 is formed in the portion 19. In complementary manner, the outside of the piston 6 bas a first portion 26 carrying a set of helical teeth 27 meshed with the teeth 25; the piston also has a second portion 28, the free end of which has a flange 29 extending radially outwardly and engaged sealingly with the portion 20 of the skirt 16 with the aid of a piston ring 30.

The piston 6, together with the hub 2 and the half bodies 10, 11, defines an annular chamber, indicated 33.

Braking means are provided between the hub 2 and the casing 9. These means comprise a ring 34 having a conical outer surface and a cylindrical inner surface and restrained axially on the hub 2.

The half body 11 in turn has a conical inner surface in contact with the conical outer surface of the ring 34; the conical coupling between the two conical surfaces of the ring 34 and of the half body 11 is indicated 35.

The ring 34 has peripheral recesses, indicated 36.

The hub 2 has an axial cavity 41 closed at one end by the cover 17 and extended at its opposite end by a feed duct 51 for pressurized oil or other servo meads for the operative control of the phase variator, with a branch directed through the structure B of the engine to a control valve 5.

The cavity 41 houses a torsionally and axially preloaded, cylindrical, helical spring 45 made from a square-sectioned wire. One end 45*a* of the spring is restrained in a first seat 47 in the cover 17 and the opposite end 45*b* is housed with clearance in a second seat 48 in the hub 2. The spring 45 pushes against the half body 10 at one end and against the hub 2 at the other end to preload the surfaces 35 for mutual coupling. At the same time, owing to the torsional load on the sets of teeth, it produces a resilient force biasing the piston 6 towards the non-actuated position of FIG. 1.

The seat 48 is extended by a discharge hole 52 opening outside the hub 2 in a rebate 53 defined between the variator 1 and the structure B.

Alternatively, one or more discharge boles 52 open in the hub 2 in positions other than in the seat 48 and, in this case, the dimensions of the seat need not allow for the clearance indicated above.

A plurality of radial holes 54 is formed in the skirt of the hub 2 at its end disposed against the cover 17, for discharging oil by blowby downstream of the sets of teeth 25, 27.

A valve 60 is provided between the feed duct 51 and a distribution and discharge duct 55 opening in the supply chamber 33.

The valve 60 comprises a tubular body 61 bearing a base 64 at one end and screwed at the opposite end into a threaded seat 65 at the end of the feed duct 51 facing the cavity 41. An obturator 63 housed in the tubular body 61 is urged resiliently into abutment with a shoulder 67 of the feed duct 51 by a spring 66.

The obturator 63 comprises a head 68 with a cylindrical skirt having a surface 69 which faces into the feed duct 51 and is therefore sensitive to the oil pressure supplied therein, as well as a rod 70 extending from the end opposite the surface 69 and bearing an enlarged, cylindrical guide portion 71. The rod 70 also serves to limit the travel of the obturator 63 by abutting the base 64, as will be explained further below.

A plurality of discharge openings 72 is formed in the tubular body 61.

The discharge holes 73 are arranged so as to put the distribution and discharge duck 55 into fluid communication with the cavity 41 when the head 68 is in abutment with the shoulder 67, closing the valve 60.

The operation of the variator 1 will be described below, starting from a first, non-actuated operative condition, shown in FIG. 1.

In this condition, the control valve 5 is shut off and there is consequently an absence of appreciable oil pressure in the feed duct 51 and the head of the obturator 63 is disposed against the shoulder 67, closing the valve 60. The distribution and discharge duct 55 is in fluid communication with the cavity 41 through the discharge openings 72, that is, the chamber 33 is connected to the discharge by the hole 52.

As a result of the operation of the control valve 5, an oil pressure is established in the feed duct 51 and produces a hydraulic thrust on the surface 69 of the head 68. When a predetermined threshold value is exceeded, and thus the hydraulic thrust exerted on the surface 69 is greater than the resilient loading of the spring 66, the obturator 63 is moved towards the base 64, bringing about a connection between the feed duct 51 and the distribution and discharge duct 55 and shutting off the previous connection between the distribution and discharge duct 55 and the discharge openings 72.

Figure 2:
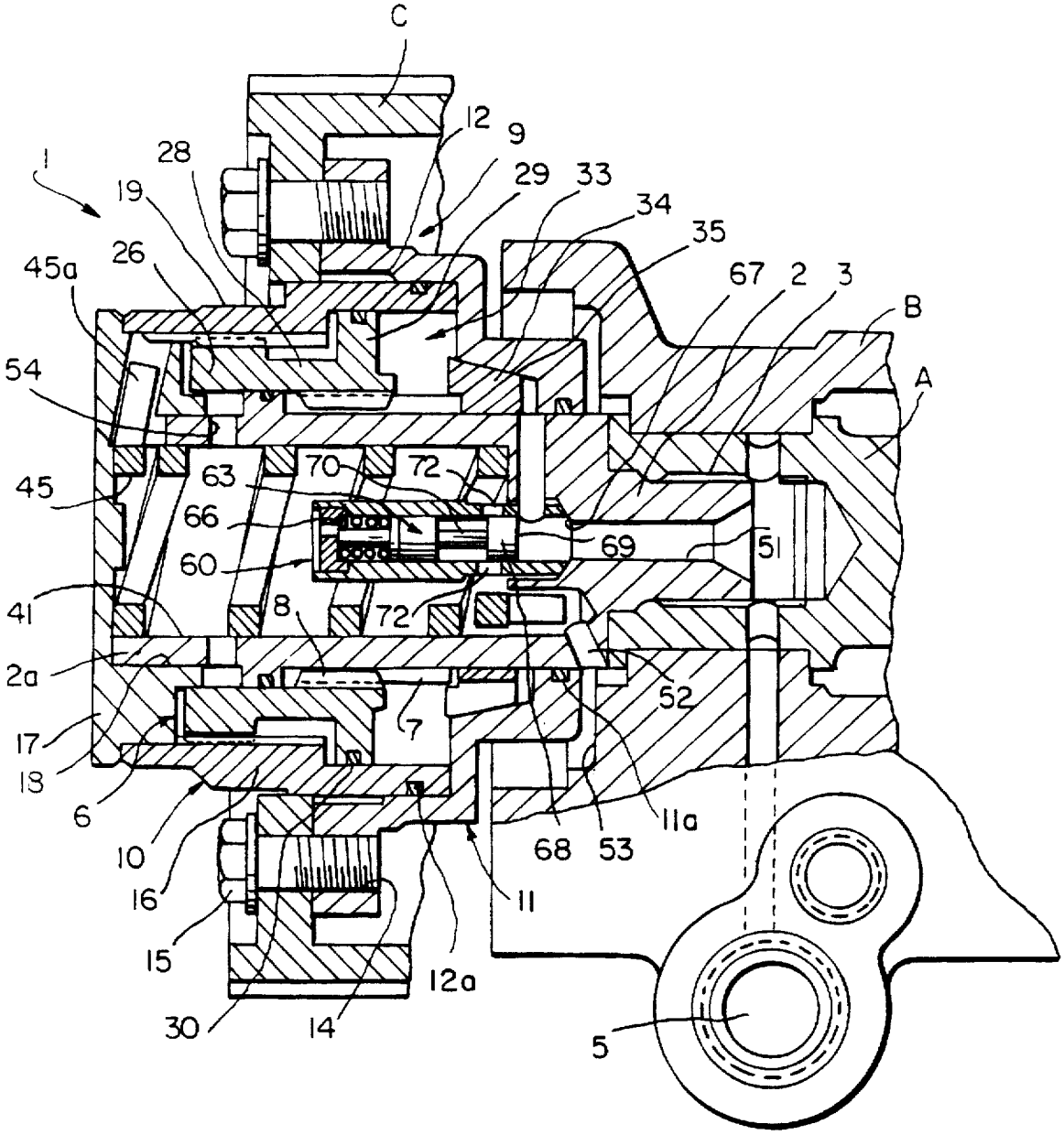

The pressurized oil is thus supplied through the duct 55 into the chamber 33 bringing about a movement of the piston 6 towards the actuated position with the opposition of the spring 45 (FIG. 2).

When the supply of oil to the feed duct 51 is shut off by the operative control of the valve 5, the pressure in the duct 51 falls below the threshold value necessary to overcome the thrust of the spring 66 and the obturator 63 is consequently moved towards the shoulder 67 until it is disposed against the surface 69 of the head 68.

As a result of this movement, the distribution and discharge duct 55 is reconnected to the discharge openings 72 and, through these, to the cavity 41 and the discharge hole 52, causing rapid and immediate discharge of the oil from the chamber 33. It will be noted that the oil is thus not forced to flow back along the feed duct 51 and through the valve 5, achieving the advantageous effect of a rapid return of the piston 6 to the non-actuated position without the need for a large resilient loading of the spring 45.

The invention thus solves the problem set, achieving numerous advantages in comparison with known solutions.

One advantage lies in the fact that the variator structure according to the invention achieves a faster return of the piston to the non-actuated position as a result of the direct discharge from the first chamber, avoiding the need to make the oil flow back along the feed duct and through the control valve of the variator.

Another advantage is constituted by the fact that the valve for the alternative connection between the distribution and discharge duct and the feed duct or the discharge opening is piloted directly by the pressure detected in the feed duct without the need for other valve systems and/or branches of the hydraulic circuit.

What is claimed is:

1. A single-acting phase variator comprising a casing, a hub and a piston jointly defining a supply chamber for a pressurized servo means, resilient means urging the piston towards a non-actuated position, and a distribution and discharge duct for the pressurized servo means, opening in the chamber, the piston being moved towards an actuated position, under the effect of the servo means supplied to the chamber and with the opposition of the resilient means, characterized in that valve means are provided in the distribution and discharge duct in communication with a feed duct, said valve means being responsive to pressure in said feed duct for alternatively connecting said distribution and discharge duct to said feed duct for the servo means or to a discharge opening for the rapid discharge of the servo means from the chamber.

2. A phase variator according to claim 1, in which the valve means comprise means for detecting the pressure established in the feed duct and obturator means subservient to the detector means for connecting the distribution and discharge duct to the discharge opening when the pressure of the servo means detected in the feed duct is below a predetermined threshold value and for connecting the distribution duct to the feed duct when the pressure of the servo means detected in the feed duct is above the threshold value.

3. A phase variator according to claim 2, in which the obturator means comprise an obturator guided for sliding in a valve, with the opposition of a spring and subject to the pressure established in the feed duct.

4. A phase variator according to claim 3, in which the obturator means and the detector means are integrated in the obturator.

5. A phase variator according to claim 4, in which the valve means comprise a tubular body housing the obturator, the tubular body being fixed in an axial seat of the hub as an extension of the feed duct, the obturator comprising a head bearing a surface facing into the feed duct.

* * * * *